US011697285B2

(12) United States Patent
Horiguchi

(10) Patent No.: US 11,697,285 B2
(45) Date of Patent: Jul. 11, 2023

(54) HEAD CHIP, LIQUID JET HEAD, LIQUID JET RECORDING DEVICE, AND METHOD OF MANUFACTURING HEAD CHIP

(71) Applicant: SII Printek Inc., Chiba (JP)

(72) Inventor: Satoshi Horiguchi, Chiba (JP)

(73) Assignee: SII PRINTEK INC., Chiba (JP)

( * ) Notice: Subject to any disclaimer, the term of this patent is extended or adjusted under 35 U.S.C. 154(b) by 69 days.

(21) Appl. No.: 17/541,566

(22) Filed: Dec. 3, 2021

(65) Prior Publication Data

US 2022/0176695 A1 Jun. 9, 2022

(30) Foreign Application Priority Data

Dec. 7, 2020 (JP) ..... 2020-202531

(51) Int. Cl.
*B41J 2/14* (2006.01)
*B41J 2/16* (2006.01)

(52) U.S. Cl.
CPC ..... *B41J 2/1433* (2013.01); *B41J 2/1623* (2013.01); *B41J 2002/14491* (2013.01); *B41J 2202/12* (2013.01)

(58) Field of Classification Search
CPC ..... B41J 2/1433; B41J 2/1623; B41J 2002/14491; B41J 2202/12; B41J 2002/14362; B41J 2/14209; B41J 2/1609; B41J 2/1632; B41J 2/1634; B41J 2002/14419; B41J 2/14
See application file for complete search history.

(56) References Cited

U.S. PATENT DOCUMENTS 10,500,855 B2 * 12/2019 Irokawa ..... B41J 2/1433
2019/0061350 A1 2/2019 Irokawa
2019/0143685 A1 5/2019 Yamamura et al.

FOREIGN PATENT DOCUMENTS

JP 2019-042979 A 3/2019
JP 2019-089234 A 6/2019

* cited by examiner

*Primary Examiner* — Lisa Solomon
(74) *Attorney, Agent, or Firm* — Crowell & Moring LLP

(57) ABSTRACT

The head chip includes an actuator plate having ejection channels and non-ejection channels extending in a Y direction and arranged alternately in an X direction, an intermediate plate overlapped with the actuator plate in a Z direction, and provided with communication holes communicated with the ejection channels and through holes communicated with the non-ejection channels, and a nozzle plate overlapped with the intermediate plate in the Z direction in a state of closing the through holes, and provided with nozzle holes which are communicated with the communication holes, jet liquid contained in the ejection channels, and are formed at positions corresponding to the ejection channels. The non-ejection channels are communicated with an outside of the head chip. The through holes are each disposed at an inner side in the X direction of the inner surfaces extending in the Y direction of the non-ejection channel viewed from the Z direction.

10 Claims, 11 Drawing Sheets

HEAD CHIP, LIQUID JET HEAD, LIQUID JET RECORDING DEVICE, AND METHOD OF MANUFACTURING HEAD CHIP

RELATED APPLICATIONS

This application claims priority to Japanese Patent Application No. 2020-202531, filed on Dec. 7, 2020, the entire content of which is incorporated herein by reference.

BACKGROUND OF THE INVENTION

1. Field of the Invention

The present disclosure relates to a head chip, a liquid jet head, a liquid jet recording device, and a method of manufacturing a head chip.

2. Description of the Related Art

An inkjet head to be installed in an inkjet printer ejects ink to a recording target medium through a head chip installed in the inkjet head. The head chip is provided with an actuator plate having ejection channels and non-ejection channels formed alternately, and a nozzle plate provided with nozzle holes from which ink housed in the ejection channels is jetted, and which are disposed at positions corresponding to the respective ejection channels.

In recent years, due to the progress of reduction in groove size of the channel, the allowable range of displacement of the actuator plate and the nozzle plate decreases. Specifically, when the position of the nozzle plate with respect to the actuator plate is shifted in a width direction of the channel, a part of the opening at the channel side of the nozzle hole can be blocked by a wall between the channels. When a part of the opening at the channel side of the nozzle hole is blocked, supply of the ink to the nozzle hole is hindered. Thus, there is a possibility that the jet characteristics of the ink deteriorate.

In JP-A-2019-42979 (Patent Literature 1) and JP-A-2019-89234 (Patent Literature 2), there is disclosed a configuration in which an intermediate plate provided with through holes each communicated with both of the ejection channel and the nozzle hole is disposed between the actuator plate and the nozzle plate, and the through holes are formed to have a size larger in the width direction of the ejection channel than the ejection channel and the nozzle hole. According to this configuration, since the displacement of the actuator plate and the nozzle plate is allowed within the range in which the nozzle hole is not blocked by the intermediate plate, it is possible to prevent the supply of the ink to the nozzle hole from being hindered.

Incidentally, when a bonding defect exists in a bonding area between the intermediate plate and the nozzle plate, the ejection channels can be communicated with each other through the bonding defect. When the ejection channels are communicated with each other, pressure propagates through the bonding defect when ejecting the ink to induce a deviation of the jet direction of the ink in some cases. Thus, there is a possibility that the printing quality deteriorates.

However, when the nozzle plate is formed of an opaque material such as a metal material, it has been difficult to optically detect the bonding defect between the nozzle plate and the intermediate plate.

Therefore, the present disclosure provides a head chip, a liquid jet head, a liquid jet recording device, and a method of manufacturing a head chip in which the deterioration of the printing quality caused by the bonding defect between a jet orifice plate and the intermediate plate is prevented.

SUMMARY OF THE INVENTION

In view of the problems described above, the present disclosure adopts the following aspects.

(1) A head chip according to an aspect of the present disclosure includes an actuator plate in which a jet channel extending in a first direction and a non-jet channel extending in the first direction are alternately arranged in a second direction crossing the first direction, an intermediate plate which is overlapped with the actuator plate in a third direction perpendicular to the first direction and the second direction, and is provided with at least one a communication hole communicated with the jet channel, and at least one a through hole communicated with the non jet channel, and a jet orifice plate which is overlapped with the intermediate plate at an opposite side to the actuator plate in the third direction in a state of closing the through hole, and is provided with a jet orifice which is communicated with the communication hole, from which liquid contained in the jet channel is jetted, and which is formed at a position corresponding to the jet channel, wherein the non jet channel is communicated with an outside of the head chip, and the through hole is disposed at an inner side in the second direction of inner surfaces extending in the first direction of the non-jet channel viewed from the third direction.

According to the present aspect, the bonding defect between the intermediate plate and the jet orifice plate is coupled to the through hole of the intermediate plate, and thus, the communication hole and the through hole of the intermediate plate are communicated with each other via the bonding defect. Thus, the jet channel and the non-jet channel are communicated with each other. Since the non jet channel is communicated with the outside of the head chip, by detecting the leakage when vacuuming is performed on the jet channel with the jet orifice blocked, it is possible to detect the presence of the bonding defect.

Here, in general, the electrode film is disposed on the inner surface extending in the first direction of the non-jet channel. In the present aspect, since the through hole is disposed at the inner side in the second direction of the inner surfaces extending in the first direction of the non-jet channel viewed from the third direction, it is possible to prevent the measure for forming the through hole from interfering with the electrode film when forming the through hole in the state in which the intermediate plate is overlapped with the actuator plate.

According to the configuration described above, it is possible to prevent the deterioration of the printing quality caused by the bonding defect by detecting the bonding defect between the intermediate plate and the jet orifice plate while preventing the deterioration of the reliability due to the damage of the electrodes film which can occur when providing the through hole to the intermediate plate.

(2) In the head chip according to the aspect (1) described above, it is possible that the jet channels include a first jet channel and a second jet channel adjacent to each other in the second direction, and the through hole is disposed between the first jet channel and the second jet channel viewed from the third direction.

According to the present aspect, the through hole is disposed on a path extending linearly from one communication hole toward the other communication hole in the bonding area between the intermediate plate and the jet orifice plate. Thus, it is possible to detect the bonding defect which is apt to induce the communication between the jet channels in particular out of the bonding defects between the intermediate plate and the jet orifice plate.

(3) In the head chip according to the aspect (2) described above, it is possible that the through hole is disposed at an inner side in the first direction of both ends of each of the first jet channel and the second jet channel viewed from the third direction.

According to the present aspect, it is possible to reduce the processing time necessary for the formation of the through hole due to the reduction of the formation range of the through hole compared to a configuration in which the through hole is disposed over an area from one outside to the other outside along the first direction of the jet channel.

(4) In the head chip according to the aspect (3) described above, it is possible that the through hole is disposed between a center in the first direction of the first jet channel and a center in the first direction of the second jet channel viewed from the third direction.

According to the present aspect, the through hole is disposed on the shortest path connecting the communication holes in the portion where the intermediate plate and the jet orifice plate are opposed to each other. Thus, it is possible to detect the bonding defect which can induce the communication between the jet channels in the part to which the fluid pressure is the most apt to be applied.

(5) In the head chip according to the aspect (2) described above, it is possible that the through hole is disposed over an entire length in the first direction between the first jet channel and the second jet channel viewed from the third direction.

According to the present aspect, the through hole is disposed on all of the paths extending linearly from one communication hole toward the other communication hole in the portion where the intermediate plate and the jet orifice plate are opposed to each other. Thus, it is possible to more surely detect the bonding defect which is apt to induce the communication between the jet channels.

(6) In the head chip according to the aspect (2) described above, it is possible that the non-jet channels include a first non-jet channel and a second non-jet channel adjacent to each other in the second direction, the through holes include a first through hole communicated with the first non jet channel, and a second through hole communicated with the second non-jet channel, and a bonding surface of the intermediate plate to the jet orifice plate is provided with a connection groove configured to connect the first through hole and the second through hole to each other.

According to the present aspect, by forming the connection groove using substantially the same measure as in the through hole so as not to penetrate the intermediate plate, it is possible to form the first through hole, the connection groove, and the second through hole in a lump. Thus, it is possible to reduce the processing time of the intermediate plate compared to when forming the through hole communicated with the first non-jet channel, and the through hole communicated with the second non-jet channel independently of each other.

(7) In the head chip according to any of the aspects (1) through (6) described above, it is possible that the intermediate plate is provided with a plurality of through holes communicated with the same non jet channel.

According to the present aspect, by forming the through holes communicated with the same non-jet channel in a distributed manner, it is possible to keep the area of the bonding area between the intermediate plate and the jet orifice plate while suppressing the decrease in the formation range of the through hole compared to a configuration in which a single through hole is formed. Therefore, it is possible to suppress the deterioration of the bonding strength between the intermediate plate and the jet orifice plate caused by forming the through holes.

(8) A liquid jet head according to an aspect of the present disclosure includes the head chip according to any of the aspects (1) through (7) described above.

According to the present aspect, since the head chip according to any of the aspects described above is provided, it is possible to provide the liquid jet head excellent in printing quality.

(9) A liquid jet recording device according to an aspect of the present disclosure includes the liquid jet head according to the aspect (8) described above.

According to the present aspect, since the liquid jet head according to the aspect described above is provided, it is possible to provide the liquid jet recording device excellent in printing quality.

(10) A method of manufacturing a head chip according to an aspect of the present disclosure includes a through hole formation step of providing a through hole to an intermediate plate overlapped with, and then bonded to, an actuator plate in a third direction perpendicular to a first direction and a second direction crossing the first direction, the actuator plate provided with a jet channel extending in the first direction and a non-jet channel extending in the first direction, the jet channel and the non-jet channel alternatively arranged in the second direction, the through hole disposed at an inner side in the second direction of inner surfaces extending in the first direction of the non-jet channel, viewed from the third direction, and a bonding step of overlapping a jet orifice plate provided with a jet orifice, from which liquid contained in the jet channel is jetted, with the intermediate plate provided with a communication hole communicated with the jet channel and the jet orifice at an opposite side to the actuator plate, and then bonding the jet orifice plate to the intermediate plate so as to close the through hole.

According to the present aspect, it is possible to form the through hole at the desired position with respect to the non-jet channel in the through hole formation step irrespective of the alignment accuracy between the actuator plate and the intermediate plate. Therefore, in the head chip provided with the intermediate plate provided with the through hole communicated with the non-jet channel, it is possible to achieve an increase in fabrication yield.

According to an aspect of the present disclosure, it is possible to suppress the deterioration of the printing quality.

DETAILED DESCRIPTION OF THE PREFERRED EMBODIMENTS

Some embodiments according to the present disclosure will hereinafter be described with reference to the drawings. It should be noted that in the following description, constituents having the same functions or similar functions are denoted by the same reference symbols. Further, the redundant descriptions of those constituents are omitted in some cases.

EMBODIMENTS

<Printer>

A printer 1 common to the embodiments will be described.

Figure 1:
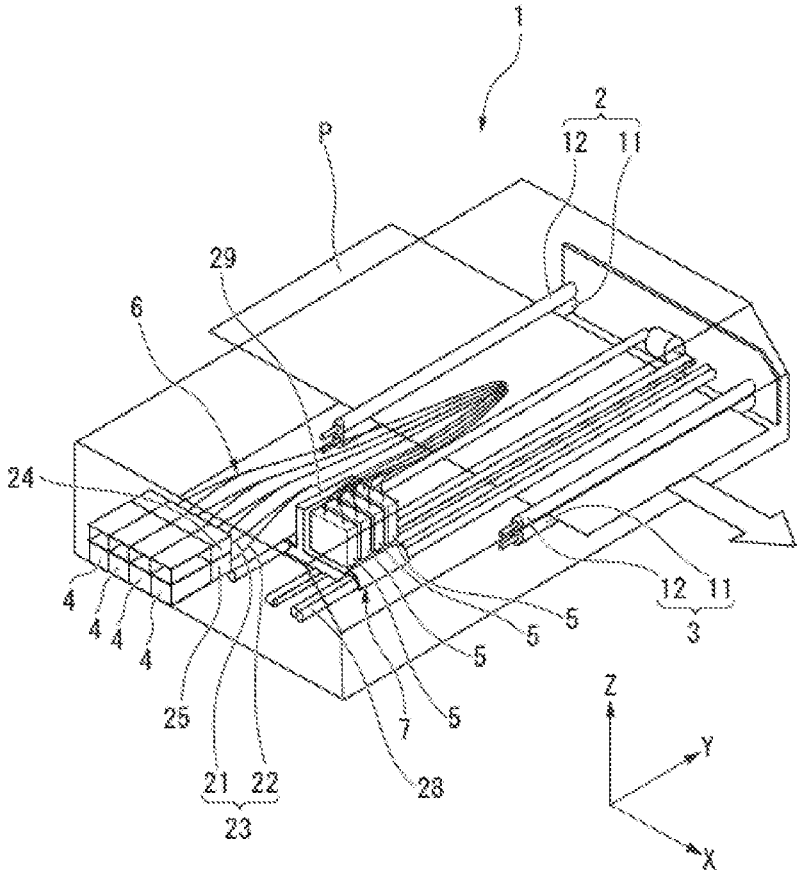
FIG. 1 is a schematic configuration diagram of a printer according to an embodiment.

FIG. 1 is a schematic configuration diagram of the printer according to the embodiments.

As shown in FIG. 1, the printer (a liquid jet recording device) 1 according to the present embodiments is provided with a pair of conveying mechanisms 2, 3, ink tanks 4, inkjet heads (liquid jet heads) 5, ink circulation mechanisms 6, and a scanning mechanism 7.

In the following explanation, the description is presented using an orthogonal coordinate system of X, Y, and Z as needed. In this case, the X direction (a second direction) coincides with a conveying direction (a sub-scanning direction) of a recording target medium P (e.g., paper). The Y direction (a first direction) coincides with a scanning direction (a main scanning direction) of the scanning mechanism 7. The Z direction (a third direction) is a height direction (a vertical direction) perpendicular to the X direction and the Y direction. In the following explanation, the description will be presented defining an arrow side as a positive (+) side, and an opposite side to the arrow as a negative (−) side in the drawings in each of the X direction, the Y direction, and the Z direction. In the present embodiments, the +Z side corresponds to an upper side in the vertical direction, and the −Z side corresponds to a lower side in the vertical direction.

The conveying mechanisms 2, 3 convey the recording target medium P toward the +X side. The conveying mechanisms 2, 3 each include a pair of rollers 11, 12 extending in, for example, the Y direction.

The ink tanks 4 respectively house ink of four colors such as yellow, magenta, cyan, and black. The inkjet heads 5 are configured so as to be able to respectively eject the ink of four colors, namely yellow, magenta, cyan, and black in accordance with the ink tank 4 coupled thereto. It should be noted that the ink to be housed in the ink tanks 4 can be conductive ink, or can also be nonconductive ink.

Figure 2:
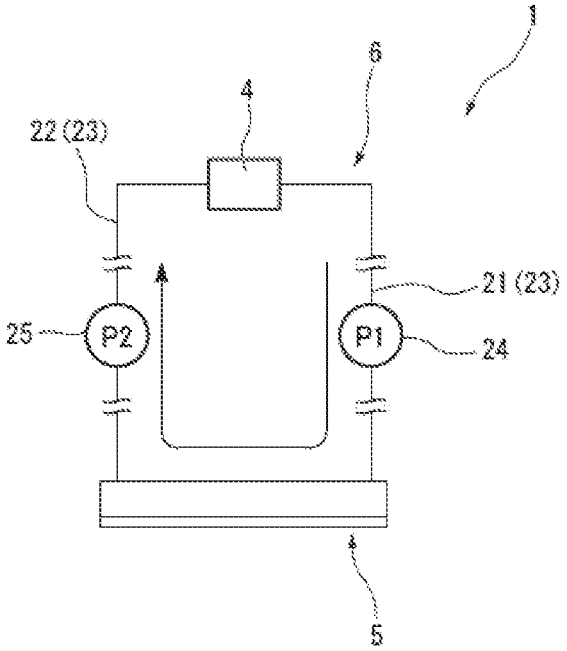
FIG. 2 is a schematic configuration diagram of an inkjet head and an ink circulation mechanism in the embodiment.

FIG. 2 is a schematic configuration diagram of the inkjet head and the ink circulation mechanism in the embodiments.

As shown in FIG. 1 and FIG. 2, the ink circulation mechanism 6 circulates the ink between the ink tank 4 and the inkjet head 5. Specifically, the ink circulation mechanism 6 is provided with a circulation flow channel 23 having an ink supply tube 21 and an ink discharge tube 22, a pressure pump 24 coupled to the ink supply tube 21, and a suction pump 25 coupled to the ink discharge tube 22.

The pressure pump 24 pressurizes the inside of the ink supply tube 21 to deliver the ink to the inkjet head 5 through the ink supply tube 21. Thus, the ink supply tube 21 is provided with positive pressure with respect to the ink jet head 5.

The suction pump 25 depressurizes the inside of the ink discharge tube 22 to suction the ink from the inkjet head 5 through the ink discharge tube 22. Thus, the ink discharge tube 22 is provided with negative pressure with respect to the ink jet head 5. It is arranged that the ink can circulate between the inkjet head 5 and the ink tank 4 through the circulation flow channel 23 by driving the pressure pump 24 and the suction pump 25.

The scanning mechanism 7 reciprocates the inkjet heads 5 in the Y direction. The scanning mechanism 7 is provided with a guide rail 28 extending in the Y direction, and a carriage 29 movably supported by the guide rail 28.

As shown in FIG. 1, the inkjet heads 5 are mounted on the carriage 29. In the illustrated example, the plurality of inkjet heads 5 are mounted on the single carriage 29 so as to be arranged side by side in the Y direction. The inkjet heads 5 are each provided with a head chip 50 (see FIG. 3), an ink supply section (not shown) for coupling the ink circulation mechanism 6 and the head chip 50, and a control section (not shown) for applying a drive voltage to the head chip 50.

First Embodiment

<Head Chip>

The head chip 50 according to a first embodiment will be described.

Figure 3:
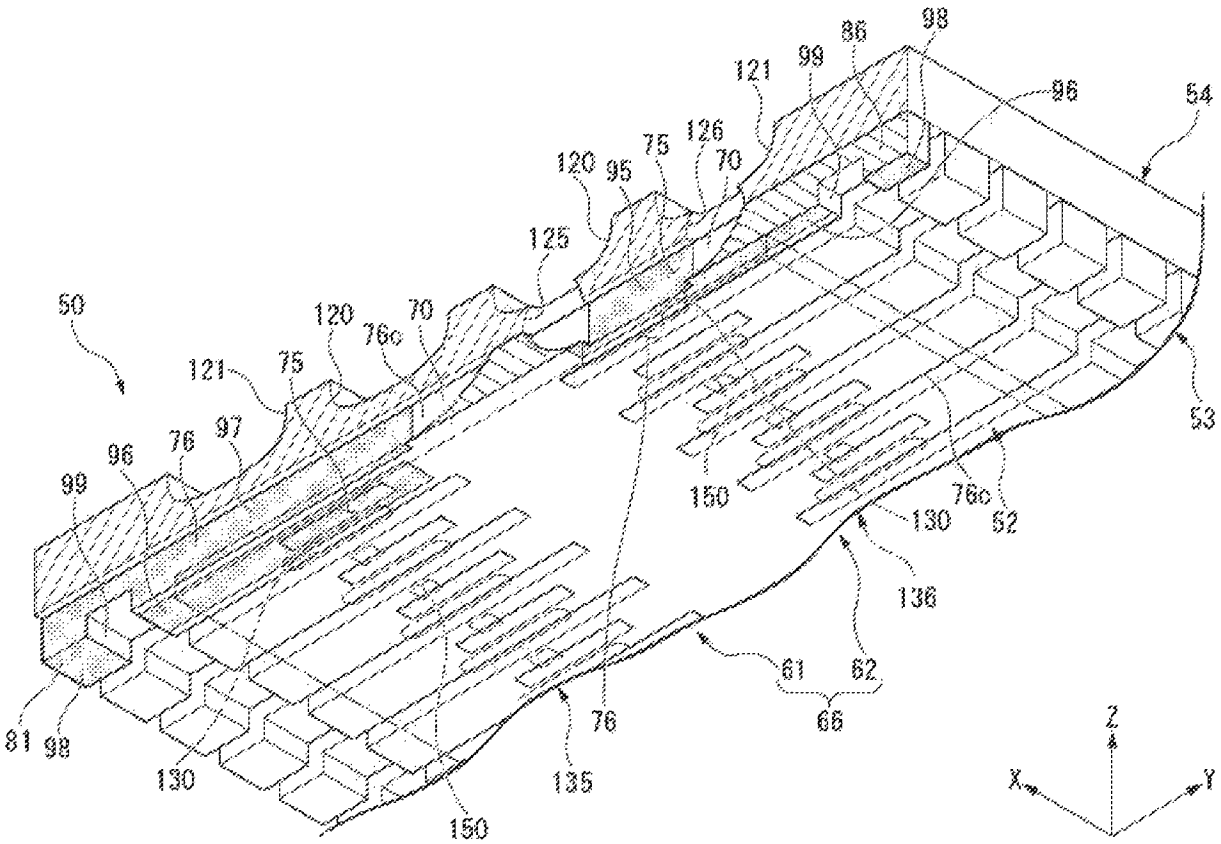
FIG. 3 is a perspective view of a head chip according to a first embodiment.
Figure 4:
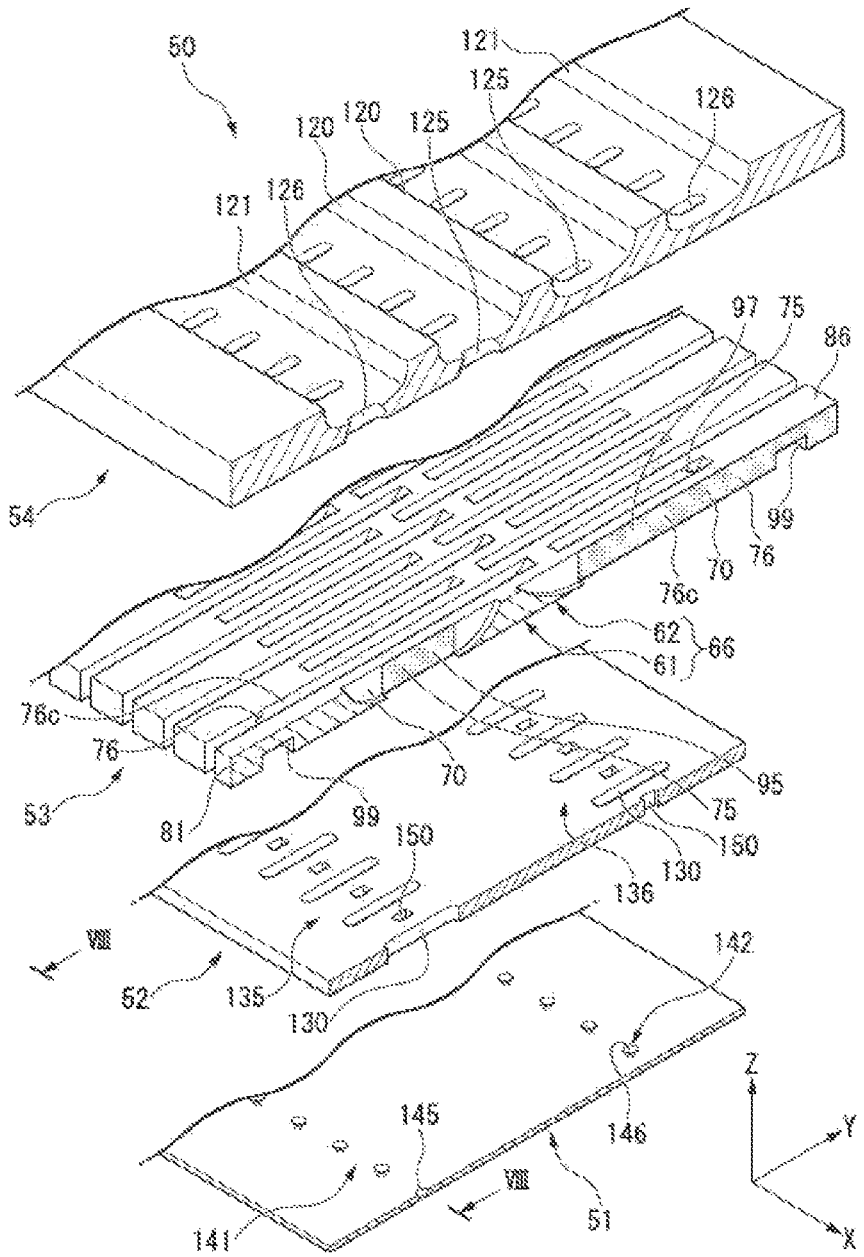
FIG. 4 is an exploded perspective view of the head chip according to the first embodiment.

FIG. 3 is a perspective view of the head chip according to the first embodiment viewed from a −Z side in the state in which a nozzle plate is detached. FIG. 4 is an exploded perspective view of the head chip according to the first embodiment.

The head chip 50 shown in FIG. 3 and FIG. 4 is a so-called circulating side-shoot type head chip which circulates the ink with the ink tank 4, and at the same time, ejects the ink from a central portion in the extending direction (the Y direction) in an ejection channel 75 described later. The head chip 50 is provided with the nozzle plate (a jet orifice plate) 51 (see FIG. 4), an intermediate plate 52, an actuator plate 53, and a cover plate 54. The head chip 50 is provided with a configuration in which the nozzle plate 51, the intermediate plate 52, the actuator plate 53, and the cover plate 54 are stacked on one another in this order in the Z direction. In the following explanation, the description is presented in some cases defining a direction (+Z side) from the nozzle plate 51 toward the cover plate 54 along the Z direction as a reverse side, and a direction (−Z side) from the cover plate 54 toward the nozzle plate 51 along the Z direction as an obverse side.

The actuator plate 53 is formed of a piezoelectric material such as PZT (lead zirconate titanate). The actuator plate 53 is a so-called chevron substrate formed by, for example, stacking two piezoelectric plates different in polarization direction in the Z direction on one another. It should be noted that the actuator plate 53 can be a so-called monopole substrate in which the polarization direction is unidirectional throughout the entire area in the Z direction.

Figure 5:
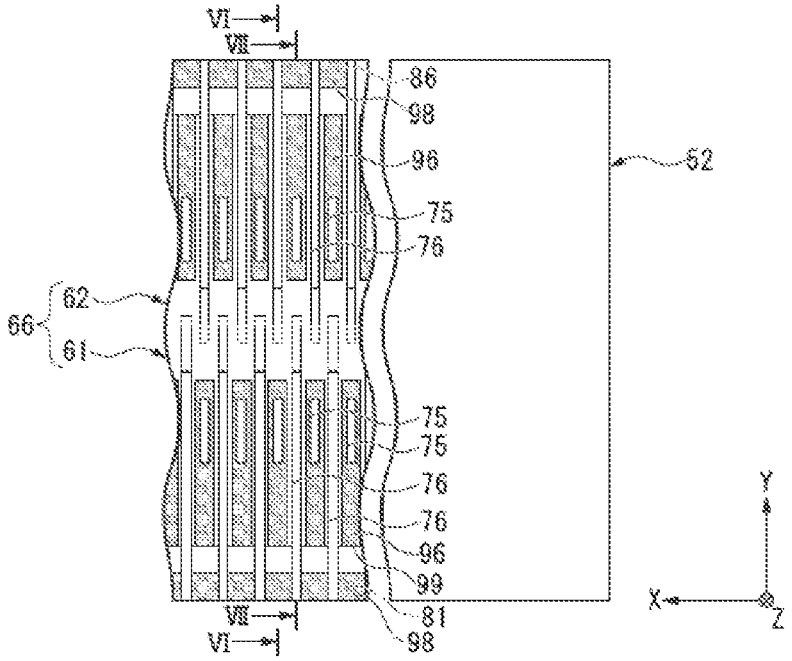
FIG. 5 is a bottom view of an actuator plate in the first embodiment.

FIG. 5 is a bottom view of an actuator plate in the first embodiment.

As shown in FIG. 4 and FIG. 5, the actuator plate 53 is provided with a plurality of (e.g., two) channel columns 61, 62. The channel columns 61, 62 extend in the X direction, and at the same time, are arranged at intervals in the Y direction. In the present embodiment, the channel columns 61, 62 correspond to a channel A column 61, and a channel column B 62. The channel A column 61 and the channel B column 62 constitute a channel group 66. The configuration of the channel columns 61, 62 will hereinafter be described citing the channel A column 61 as an example.

As shown in FIG. 5, The channel A column 61 has the ejection channels (jet channels) 75 filled with the ink, and non-ejection channels (non-jet channels) 76 not filled with the ink. The channels 75, 76 each extend linearly in the Y direction, and at the same time, are arranged side by side at intervals in the X direction in the plan view viewed from the Z direction. In the actuator plate 53, a portion located between the ejection channel 75 and the non-ejection channel 76 constitutes a drive wall 70 (see FIG. 4) which partitions the ejection channel 75 and the non-ejection channel 76 from each other in the X direction. It should be noted that the configuration in which the channel extension direction coincides with the Y direction will be described in the present embodiment, but the channel extension direction can cross the Y direction.

Figure 6:
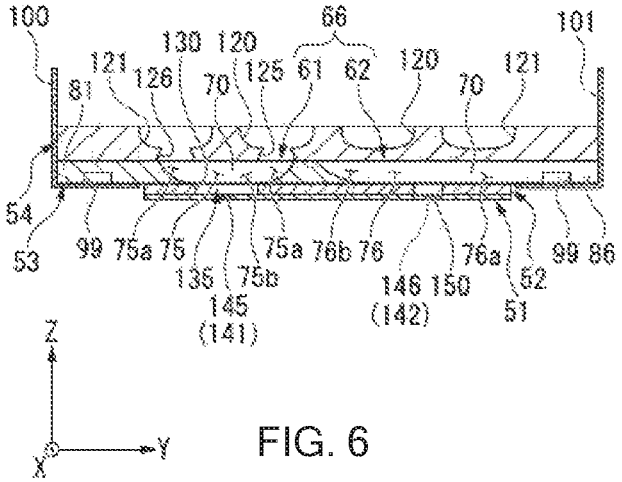
FIG. 6 is a cross-sectional view of the head chip corresponding to the line VI-VI shown in FIG. 5.

FIG. 6 is a cross-sectional view of the head chip corresponding to the line VI-VI shown in FIG. 5.

As shown in FIG. 6, the ejection channel 75 is formed to have a curved shape convex toward the obverse surface in a side view viewed from the X direction. The ejection channels 75 are formed by, for example, making a dicer having a disk-like shape enter the actuator plate 53 from the reverse surface (the +Z side) thereof. Specifically, the ejection channel 75 has uprise parts 75*a* located at both end portions in the Y direction, and a penetration part 75*b* located between the uprise parts 75*a*.

The uprise part 75*a* has a circular arc shape which extends along, for example, the curvature radius of the dicer and has a uniform curvature radius when viewed from the X direction. The uprise part 75*a* extends while curving toward the reverse side as getting away from the penetration part 75*b* in the Y direction.

The penetration part 75*b* penetrates the actuator plate 53 in the Z direction.

Figure 7:
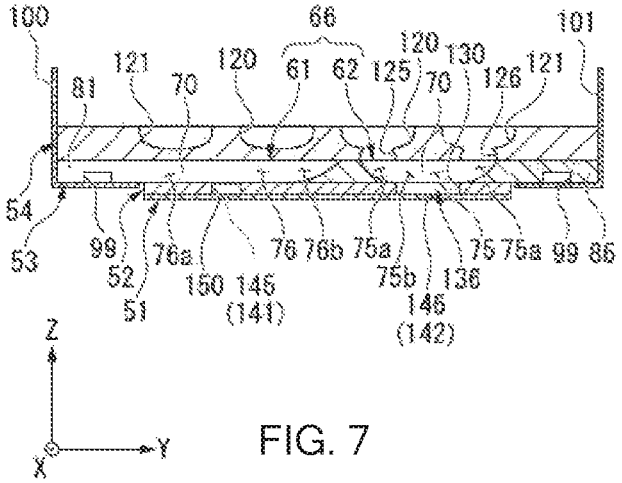
FIG. 7 is a cross-sectional view of the head chip corresponding to the line VII-VII shown in FIG. 5.

FIG. 7 is a cross-sectional view of the head chip corresponding to the line VII-VII shown in FIG. 5.

As shown in FIG. 7, the non-ejection channel 76 is adjacent to the ejection channel 75 across the drive wall 70 in the X direction. The ejection channels 76 are formed by, for example, making a dicer having a disk-like shape enter the actuator plate 53 from the reverse surface (the +Z side) thereof. The non-ejection channel 76 is provided with a penetration part 76*a* and an uprise part 76*b*.

The penetration part 76*a* penetrates the actuator plate 53 in the Z direction. In other words, the penetration part 76*a* is formed to have a uniform groove depth in the Z direction. The penetration part 76*a* constitutes a portion other than the +Y side end portion in the non-ejection channel 76.

The uprise part 76*b* constitutes the +Y side end portion in the non-ejection channel 76. The uprise part 76*b* has a circular arc shape which extends along, for example, the curvature radius of the dicer and has a uniform curvature radius when viewed from the X direction. The uprise part 76*b* extends while curving toward the reverse side as getting away from the penetration part 76*a* in the Y direction.

As shown in FIG. 5, the channel B column 62 is disposed at the +Y side of the channel A column 61 in the actuator plate 53. Similarly to the channel A column 61 described above, the channel B column 62 has a configuration in which the ejection channels (jet channels) 75 and the non-ejection channels (non-jet channels) 76 are arranged alternately in the X direction. Specifically, the ejection channels 75 and the non-ejection channels 76 in the channel B column 62 are arranged so as to be shifted as much as a half pitch with respect to the arrangement pitch of the ejection channels 75 and the non-ejection channels 76 in the channel A column 61. Therefore, in the inkjet head 5 according to the present embodiment, the ejection channels 75 in the channel A column 61 and the channel B column 62 are arranged in a zigzag manner (a staggered manner), and the non-ejection channels 76 in the channel A column 61 and the channel B column 62 are arranged in a zigzag manner (a staggered manner). In other words, the ejection channel 75 and the non-ejection channel 76 are opposed to each other between the channel columns 61, 62 adjacent to each other. It should be noted that the ejection channels 75 can be opposed to each other in the Y direction between the channel columns 61, 62, and the non-ejection channels 76 can be opposed to each other in the Y direction between the channel columns 61, 62.

In the actuator plate 53, a portion located at the −Y side of the ejection channel 75 (the penetration part 75*b*) in the channel A column 61 constitutes a first area 81. In the actuator plate 53, a portion located at the +Y side of the ejection channel 75 in the channel B column 62 constitutes a second area 86.

As shown in FIG. 7, in the channel A column 61, the penetration part 76*a* of the non-ejection channel 76 penetrates the first area 81 in the Y direction and the Z direction to open in the side surface facing to the −Y side of the actuator plate 53. In the channel B column 62, the penetration part 76*a* of the non-ejection channel 76 penetrates the second area 86 in the Y direction and the Z direction to open in the side surface facing to the +Y side of the actuator plate 53. Thus, the non-ejection channels 76 are communicated with the outside of the head chip 50.

Figure 8:
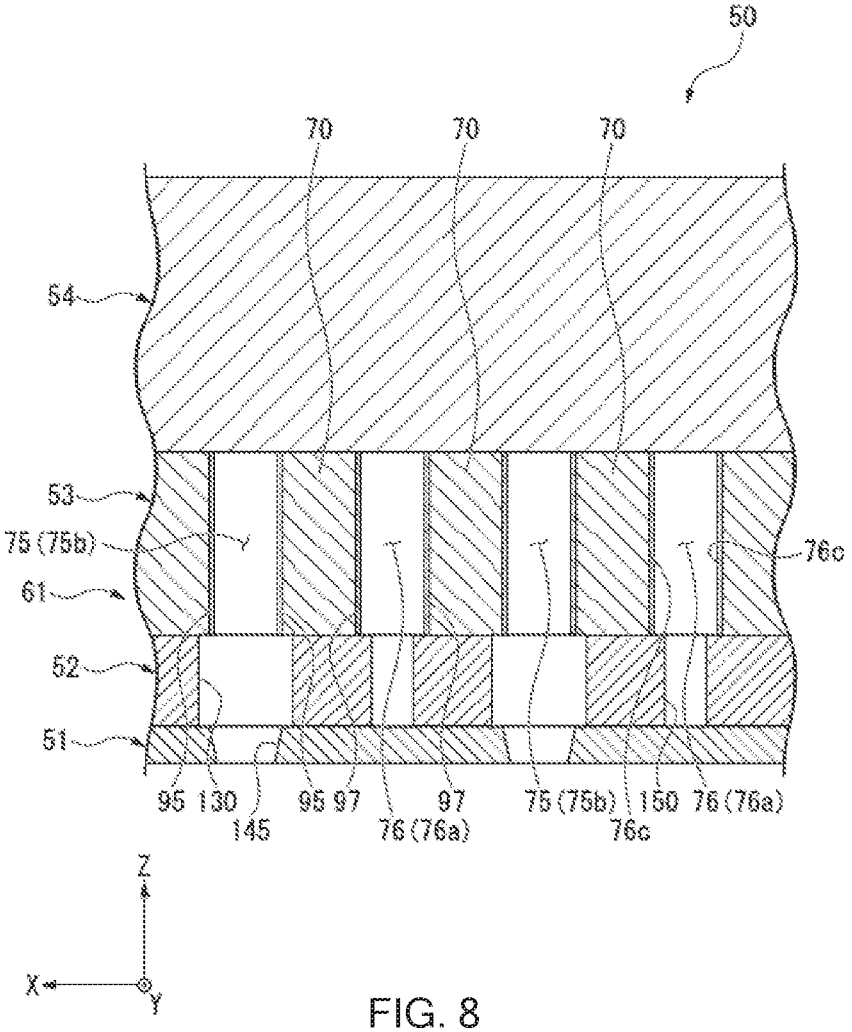
FIG. 8 is a cross-sectional view along the line VIII-VIII shown in FIG. 4.

FIG. 8 is a cross-sectional view along the line VIII-VIII shown in FIG. 4.

As shown in FIG. 8, common electrodes 95 are each formed on an inner surface (an inner side surface facing the ejection channel 75 out of the drive wall 70) extending in the Y direction of the ejection channel 75. The common electrodes 95 are each formed throughout the entire area in the Z direction on the inner side surface of the ejection channel 75. The common electrodes 95 are made equivalent in length in the Y direction to the penetration part 75*b* of the ejection channel 75 (equivalent in length in the Y direction to an opening length of the ejection channel 75 on the obverse surface of the actuator plate 53).

Individual electrodes 97 are each formed on an inner surface 76*c* (an inner side surface facing the non-ejection channel 76 out of the drive wall 70) extending in the Y direction of the non-ejection channel 76. The individual electrodes 97 are each formed throughout the entire area in the Z direction on the inner side surface of the non-ejection channel 76.

As shown in FIG. 5, on the obverse surface of the actuator plate 53, there is formed a plurality of common terminals 96. The common terminals 96 are made to have strip-like shapes extending in the Y direction in parallel to each other. The common terminals 96 are each coupled to the pair of common electrodes 95 at an opening edge of the ejection channel 75 corresponding to the common terminal 96. The common terminals 96 are each terminated in corresponding one of the areas 81, 86.

In a portion located at an outer side in the Y direction of the common terminal 96 on the obverse surface of each of the areas 81, 86, there is formed an individual terminal 98. The individual terminal 98 is provided with a strip-like shape extending in the X direction. The individual terminal 98 couples the individual electrodes 97 opposed to each other in the X direction across the ejection channel 75 at the opening edges of the non-ejection channels 76 which are opposed to each other in the X direction across the ejection channel 75. It should be noted that in a portion located between the common terminal 96 and the individual terminal 98 in each of the areas 81, 86, there is formed a compartment groove 99. The compartment groove 99 extends in the X direction in each of the areas 81, 86. The compartment groove 99 separates the common terminal 96 and the individual terminal 98 from each other. It should be noted that in FIG. 3, FIG. 4, and so on, the electrodes 95, 97 and the terminals 96, 98 are only partially shown.

As shown in FIG. 6, a first flexible printed board 100 is pressure-bonded to the obverse surface of the first area 81. The first flexible printed board 100 is coupled to the common terminals 96 and the individual terminals 98 corresponding to the channel A column 61 on the obverse surface of the first area 81. The first flexible printed board 100 is extracted toward the +Z side passing the −Y side of the actuator plate 53.

A second flexible printed board 101 is pressure-bonded to the obverse surface of the second area 86. The second flexible printed board 101 is coupled to the common terminals 96 and the individual terminals 98 corresponding to the channel B column 62 on the obverse surface of the second area 86. The second flexible printed board 101 is extracted toward the +Z side passing the +Y side of the actuator plate 53.

As shown in FIG. 3 and FIG. 4, the cover plate 54 is bonded to the reverse surface of the actuator plate 53 so as to close the channel group 66. In the cover plate 54, at positions corresponding respectively to the channel columns 61, 62, there are formed entrance common ink chambers 120 and exit common ink chambers 121.

The entrance common ink chamber 120 is formed at a position overlapping the +Y side end portion of the ejection channel 75 in the plan view in, for example, the channel A column 61. The entrance common ink chamber 120 extends in the X direction with a length sufficient for straddling the channel A column 61, and at the same time, opens on the reverse surface of the cover plate 54.

The exit common ink chamber 121 is formed at a position overlapping the −Y side end portion of the ejection channel 75 in the plan view in, for example, the channel A column 61. The exit common ink chamber 121 extends in the X direction with a length sufficient for straddling the channel A column 61, and at the same time, opens on the reverse surface of the cover plate 54.

In the entrance common ink chamber 120, at the positions corresponding to the ejection channels 75 in the channel A column 61, there are formed entrance slits 125, respectively. The entrance slits 125 each communicate the +Y side end portion of corresponding one of the ejection channels 75 and the entrance common ink chamber 120 with each other.

In the exit common ink chamber 121, at the positions corresponding to the ejection channels 75 in the channel A column 61, there are formed exit slits 126, respectively. The exit slits 126 each communicate the −Y side end portion of corresponding one of the ejection channels 75 and the exit common ink chamber 121 with each other. Therefore, the entrance slits 125 and the exit slits 126 are communicated with the respective ejection channels 75 on the one hand, but are not communicated with the non-ejection channel 76 on the other hand.

The intermediate plate 52 is bonded to the obverse surface of the actuator plate 53 so as to close the channel group 66. The intermediate plate 52 is formed of a piezoelectric material such as PZT similarly to the actuator plate 53. The intermediate plate 52 is thinner in thickness in the Z direction than the actuator plate 53. The intermediate plate 52 is made shorter in dimension in the Y direction than the actuator plate 53. Therefore, at the both sides in the Y direction of the intermediate plate 52, there are exposed the both end portions (e.g., the first area 81) in the Y direction in the actuator plate 53. In the both end portions in the Y direction in the actuator plate 53, the portions exposed from the intermediate plate 52 function as pressure-bonding areas for the flexible printed boards 100, 101, respectively. It should be noted that the intermediate plate 52 can be formed of a material (e.g., a nonconductive material such as polyimide or alumina) other than the piezoelectric material. The intermediate plate 52 is provided with communication holes 130 and through holes 150.

The communication holes 130 overlap the penetration parts 75*b* of the ejection channels 75 in the plan view, respectively. The communication holes 130 are communicated with the penetration parts 75*b* of the corresponding ejection channels 75, respectively, at the obverse surface side of the actuator plate 53. The communication hole 130 is formed to have an oval shape having a longitudinal direction set to the Y direction. The communication hole 130 is wider in dimension in the X direction than the penetration part 75*b*. It should be noted that the communication hole 130 can be shorter in dimension in the X direction than the penetration part 75*b*.

The through holes 150 overlap the penetration parts 76*a* of the non-ejection channels 76 in the plan view, respectively. The through holes 150 are communicated with the penetration parts 76*a* of the corresponding non-ejection channels 76, respectively, at the obverse surface side of the actuator plate 53.

Figure 9:
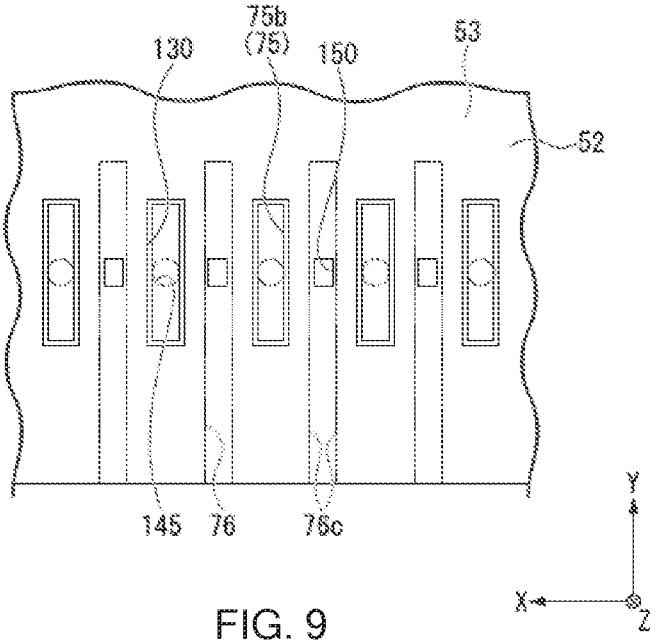
FIG. 9 is a bottom view of an intermediate plate and the actuator plate in the first embodiment.

FIG. 9 is a bottom view of the intermediate plate and the actuator plate in the first embodiment.

As shown in FIG. 9, the through holes 150 are each disposed at an inner side in the X direction of the inner surfaces 76*c* extending in the Y direction of the non-ejection channel 76 in the plan view. The whole of the through hole 150 overlaps the non-ejection channel 76 in the plan view. The through hole 150 is disposed between the penetration parts 75*b* of the pair of ejection channels 75 (a first jet channel and a second jet channel) adjacent to each other in the X direction. The through hole 150 is disposed at an inner side in the Y direction of both ends of the penetration part 75*b* of each of the pair of ejection channels 75 adjacent to each other in the X direction. In the present embodiment, the through hole 150 is formed to have a rectangular planar shape smaller in the X direction than the non-ejection channel 76 and smaller in the Y direction than the penetration part 75*b* of the ejection channel 75. The through hole 150 is disposed between the respective centers in the Y direction of the pair of ejection channels 75 in the plan view.

As shown in FIG. 3 and FIG. 4, in the intermediate plate 52, the areas in which the communication holes 130 are arranged side by side in the X direction respectively constitute communication areas 135, 136. In the present embodiment, the communication areas 135, 136 are a communication A area 135 overlapping the channel A column 61, and a communication B area 136 overlapping the channel B column 62. The communication areas 135, 136 are disposed at a distance in the Y direction.

As shown in FIG. 4, the nozzle plate 51 is bonded to an obverse surface of the intermediate plate 52. The nozzle plate 51 is made equivalent in width in the Y direction to the intermediate plate 52. In the present embodiment, the nozzle plate 51 is formed of a metal material (stainless steel, Ni—Pd, or the like) such as stainless steel. It should be noted that it is possible for the nozzle plate 51 to have a single layer structure or a laminate structure with a resin material such as polyimide, glass, silicone, or the like besides the metal material.

The nozzle plate 51 is provided with two nozzle arrays (a nozzle A array 141 and a nozzle B array 142) extending in the X direction arranged at a distance in the Y direction.

The nozzle arrays 141, 142 each include a plurality of nozzle holes (nozzle A holes 145 and nozzle B holes 146) each penetrating the nozzle plate 51 in the Z direction. The nozzle holes 145, 146 are each arranged at intervals in the X direction. Each of the nozzle holes 145, 146 is formed to have, for example, a taper shape having the inner diameter gradually decreasing in a direction from the reverse side toward the obverse side. The maximum internal diameter of each of the nozzle holes 145, 146 is larger than the width in the Y direction of the ejection channel 75, and smaller than the width in the Y direction of the communication hole 130.

As shown in FIG. 6 and FIG. 7, the nozzle A holes 145 are each communicated with a central portion in the Y direction of the ejection channel 75 in the channel A column 61 through the communication hole 130 in the communication A area 135. The nozzle B holes 146 are each communicated with a central portion in the Y direction of the ejection channel 75 in the channel B column 62 through the communication hole 130 in the communication B area 136. The nozzle plate 51 does not have a hole communicated with the through hole 150 in the intermediate plate 52, and closes the through holes 150 from the obverse surface side.

<Method of Manufacturing Head Chip>

A method of manufacturing the head chip 50 according to the present embodiment will be described. The method of manufacturing the head chip according to the present embodiment is provided with a first bonding step, a first inspection step, a through hole formation step, a second bonding step, and a second inspection step.

Figure 10:
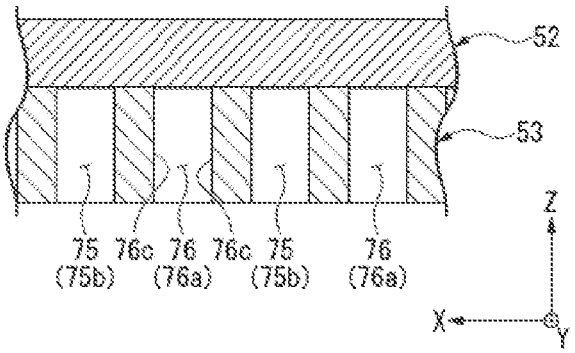
FIG. 10 is a diagram for explaining a method of manufacturing the head chip according to the first embodiment.
Figure 11:
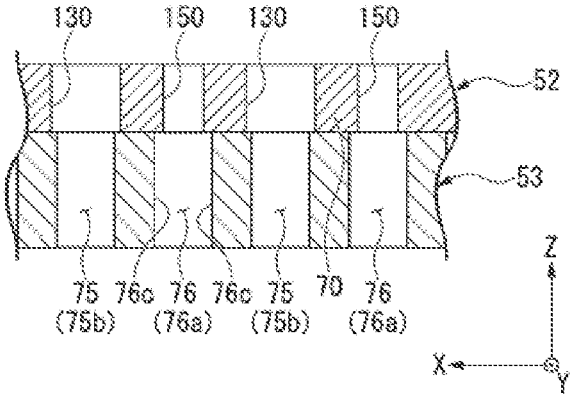
FIG. 11 is a diagram for explaining the method of manufacturing the head chip according to the first embodiment.
Figure 12:
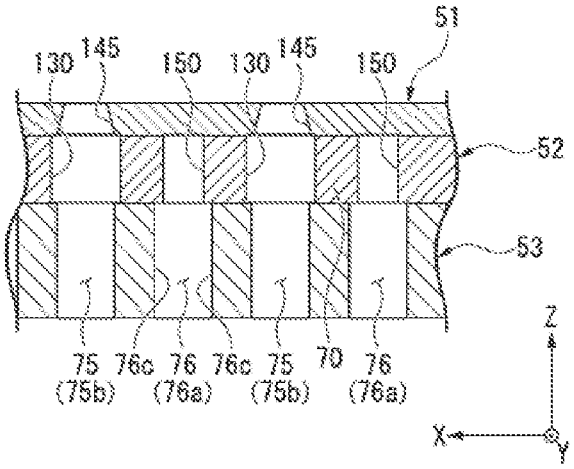
FIG. 12 is a diagram for explaining the method of manufacturing the head chip according to the first embodiment.

FIG. 10 through FIG. 12 are diagrams for explaining the method of manufacturing the head chip according to the first embodiment, and are each a cross-sectional view corresponding to FIG. 8.

As shown in FIG. 10, in the first bonding step, the intermediate plate 52 is stacked in the Z direction on the actuator plate 53 to bond them to each other. For example, the actuator plate 53 and the intermediate plate 52 are bonded to each other with an adhesive. The intermediate plate 52 to be bonded to the actuator plate 53 in the first bonding step is not provided with both of the communication holes 130 and the through holes 150. It should be noted that in each of the drawings of FIG. 10 through FIG. 12, illustration of the individual electrodes 97 formed on the inner surfaces 76*c* of the non-jet channels 76 is omitted.

Subsequently, in the first inspection step, a bonding defect in the bonding area between the actuator plate 53 and the intermediate plate 52 is detected. The bonding defect as the detection object is a leak path which communicates the ejection channel 75 and the non-ejection channel 76 with each other. In the first inspection step, vacuuming is performed on each of the ejection channels 75, and the presence or absence of the leakage on that occasion is judged. When there exists the leak path which communicates the ejection channel 75 and the non-ejection channel 76 with each other, a gas inflows into the ejection channel 75 from the non-ejection channel 76 opening in the side surface of the actuator plate 53 through the leak path, and therefore, it is possible to detect the bonding defect.

Subsequently, as shown in FIG. 11, in the through hole formation step, the communication holes 130 and the through holes 150 are provided to the intermediate plate 52 for those having passed the first inspection step. On this occasion, the through holes 150 are each formed at the inner side in the X direction of the inner surfaces 76*c* extending in the Y direction of the non-ejection channel 76. For example, in the through hole formation step, the communication holes 130 and the through holes 150 are provided to the intermediate plate 52 using a laser.

Subsequently, as shown in FIG. 12, in the second bonding step, the nozzle plate 51 provided with the nozzle holes 145, 146 is stacked on the opposite side of the intermediate plate 52 to the actuator plate 53 to bond the nozzle plate 51 to the intermediate plate 52. For example, the intermediate plate 52 and the nozzle plate 51 are bonded to each other with an adhesive. By bonding the nozzle plate 51 to the intermediate plate 52, the nozzle holes 145, 146 are respectively communicated with the communication holes 130, and at the same time, the through holes 150 are closed by the nozzle plate 51.

Subsequently, in the second inspection step, a bonding defect in the bonding area between the intermediate plate 52 and the nozzle plate 51 is detected. The bonding defect as the detection object is a leak path which communicates the communication hole 130 and the through hole 150 with each other. In the second inspection step, vacuuming is performed on each of the ejection channels 75 in the state of blocking the nozzle holes 145, 146, and the presence or absence of the leakage on that occasion is judged. The nozzle holes 145, 146 are blocked by overlapping a jig not shown on the opposite side of the nozzle plate 51 to the intermediate plate 52. When there exists the leak path which communicates the communication hole 130 and the through hole 150 with each other, a gas inflows into the ejection channel 75 from the non-ejection channel 76 opening in the side surface of the actuator plate 53 through the through hole 150, the leak path, and the communication hole 130, and therefore, it is possible to detect the bonding defect.

Then, by pressure-bonding the flexible printed boards 100, 101 for those having passed the second inspection step, the head chip 50 is completed.

It should be noted that although in the present embodiment, the intermediate plate 52 not provided with the communication holes 130 is used in the first bonding step, this is not a limitation. Specifically, it is possible to use the intermediate plate 52 provided with the communication holes 130 in the first bonding step. In this case, by blocking the communication holes 130 using a jig in the first inspection step similarly to the second inspection step, it is possible to detect the leak path communicating the ejection channel 75 and the non-ejection channel 76 with each other.

<Operation of Printer>

Then, when recording a character, a figure, or the like on the recording target medium P using the printer 1 configured as described above will hereinafter be described.

It should be noted that it is assumed that as an initial state, the sufficient ink having colors different from each other is respectively encapsulated in the four ink tanks 4 shown in FIG. 1. Further, there is provided the state in which the inkjet heads 5 are filled with the ink in the ink tanks 4 via the ink circulation mechanisms 6, respectively.

In such an initial state, when making the printer 1 operate, the recording target medium P is conveyed toward the +X side while being pinched by the rollers 11, 12 of the conveying mechanisms 2, 3. Further, by the carriage 29 moving in the Y direction at the same time, the inkjet heads 5 mounted on the carriage 29 reciprocate in the Y direction.

During the reciprocation of the inkjet heads 5, the ink is arbitrarily ejected toward the recording target medium P from each of the inkjet heads 5. Thus, it is possible to perform recording of the character, the image, and the like on the recording target medium P.

Here, the operation of each of the inkjet heads 5 will hereinafter be described in detail.

In such circulating side-shoot type inkjet head 5 as in the present embodiment, first, by making the pressure pump 24 and the suction pump 25 shown in FIG. 2 operate, the ink is circulated in the circulation flow channel 23. In this case, the ink circulating through the ink supply tube 21 is supplied into each of the ejection channels 75 through the entrance common ink chambers 120 and the entrance slits 125. The ink supplied into each of the ejection channels 75 circulates the ejection channel 75 in the Y direction. Subsequently, the ink is discharged to the exit common ink chambers 121 through the exit slits 126, and is then returned to the ink tank 4 through the ink discharge tube 22. Thus, it is possible to circulate the ink between the inkjet head 5 and the ink tank 4.

Then, when the reciprocation of the inkjet head 5 is started due to the translation of the carriage 29 (see FIG. 1), the drive voltages are applied to the electrodes 95, 97 via the flexible printed boards 100, 101. On this occasion, the individual electrode 97 is set at a drive potential Vdd, and the common electrode 95 is set at a reference potential GND to apply the drive voltage between the electrodes 95, 97. Then, a thickness shear deformation occurs in the two drive walls 70 partitioning the ejection channel 75, and the two drive walls 70 each deform so as to protrude toward the non-ejection channel 76. Specifically, by applying the voltage between the electrodes 95, 97, the drive walls 70 each make a flexural deformation to form a V-shape centering on an intermediate portion in the Z direction. Thus, the volume of the ejection channel 75 increases. Further, since the volume of the ejection channel 75 has increased, the ink retained in the entrance common ink chamber 120 is induced into the ejection channel 75 through the entrance slit 125. The ink having been induced into the ejection channel 75 propagates inside the ejection channel 75 as a pressure wave. The voltage applied between the electrodes 95, 97 is set to zero at the timing when the pressure wave reaches corresponding one of the nozzle holes 145, 146. Thus, the drive walls 70 are restored, and the volume of the ejection channel 75 having once increased is restored to the original volume. Due to this operation, the internal pressure of the ejection channel 75 increases to pressurize the ink. As a result, the ink shaped like a droplet is ejected outside through the communication hole 130 and corresponding one of the nozzle holes 145, 146, and thus, it is possible to record the character, the figure, and the like on the recording target medium P as described above.

As described hereinabove, the head chip 50 according to the present embodiment is provided with the intermediate plate 52 and the nozzle plate 51, wherein the intermediate plate 52 is provided with the communication holes 130 respectively communicated with the ejection channels 75 and the through holes 150 respectively communicated with the non-ejection channels 76, the nozzle plate 51 is overlapped with the intermediate plate 52 in the state in which the through holes 150 are closed, the nozzle plate 51 is provided with the nozzle holes 145, 146 formed at the positions corresponding to the ejection channels 75, the nozzle holes 145, 146 are respectively communicated with the communication holes 130, and the ink contained in the ejection channels 75 is jetted from the nozzle holes 145, 146. Further, the non-ejection channels 76 are communicated with the outside, and the through holes 150 are each disposed at the inner side in the Y direction of the inner surfaces 76*c* extending in the Y direction of the non-ejection channel 76 in the plan view. According to this configuration, the bonding defect between the intermediate plate 52 and the nozzle plate 51 is coupled to the through hole 150 of the intermediate plate 52, and thus, the communication hole 130 and the through hole 150 of the intermediate plate 52 are communicated with each other via the bonding defect. Thus, the ejection channel 75 and the non-ejection channel 76 are communicated with each other. Since the non-ejection channels 76 are communicated with the outside of the head chip 50, by detecting the leakage when vacuuming is performed on the election channels 75 with the nozzle holes 145, 146 blocked, it is possible to detect the presence of the bonding defect.

Here, the individual electrode 97 is disposed on the inner surface 76*c* extending in the Y direction of the non-ejection channel 76. In the present embodiment, since the through holes 150 are each disposed at the inner side in the X direction of the inner surfaces 76*c* extending in the Y direction of the non-ejection channel 76 in the plan view, it is possible to prevent the measure such as a laser for forming the through holes 150 from interfering with the individual electrodes 97 when forming the through holes 150 in the state in which the intermediate plate 52 is overlapped with the actuator plate 53.

According to the configuration described above, it is possible to prevent the deterioration of the printing quality caused by the bonding defect by detecting the bonding defect between the intermediate plate 52 and the nozzle plate 51 while preventing the deterioration of the reliability due to the damage of the individual electrodes 97 which can occur when providing the through holes 150 to the intermediate plate 52.

Further, the method of manufacturing the head chip 50 according to the present embodiment is provided with the through hole formation step and the second bonding step, wherein the intermediate plate 52 having been overlapped with and then bonded to the actuator plate 53 is provided with the through holes 150 each formed at the inner side in the X direction of the inner surfaces 76*c* extending in the Y direction of the non-ejection channel 76 in the plan view in the through hole formation step, and the nozzle plate 51 is overlapped with and then bonded to the opposite side of the intermediate plate 52 to the actuator plate 53 to close the through holes 150 in the second bonding step. According to this manufacturing method, it is possible to form the through holes 150 at the desired positions with respect to the non-ejection channels 76 in the through hole formation step irrespective of the alignment accuracy between the actuator plate 53 and the intermediate plate 52. Therefore, in the head chip 50 provided with the intermediate plate 52 provided with the through holes 150 respectively communicated with the non-ejection channels 76, it is possible to achieve an increase in fabrication yield.

Further, the through holes 150 are each disposed between the penetration parts 75*b* of the pair of ejection channels 75 adjacent to each other in the plan view. According to this configuration, the through holes 150 are each disposed on a path extending linearly from one communication hole 130 toward the other communication hole 130 in the bonding area between the intermediate plate 52 and the nozzle plate 51. Thus, it is possible to detect the bonding defect which is apt to induce the communication between the ejection channels 75 in particular out of the bonding defects between the intermediate plate 52 and the nozzle plate 51.

The through holes 150 are each disposed at the inner side in the Y direction of both ends of each of the penetration parts 75*b* of the pair of ejection channels 75 adjacent to each other in the plan view. According to this configuration, it is possible to reduce the processing time necessary for the formation of the through holes 150 due to the reduction of the formation range of the through holes 150 compared to a configuration in which the through holes are each disposed over an area from one outside to the other outside along the Y direction of the penetration part 75*b* of the ejection channel 75.

The through holes 150 are each disposed between the centers in the Y direction of the penetration parts 75*b* of the pair of ejection channels 75 adjacent to each other in the plan view. According to this configuration, the through hole 150 is disposed on the shortest path connecting the communication holes 130 in the portion where the intermediate plate 52 and the nozzle plate 51 are opposed to each other. Thus, it is possible to detect the bonding defect which can induce the communication between the ejection channels 75 in the part to which the fluid pressure is the most apt to be applied.

Further, in the inkjet head 5 and the printer 1 according to the present embodiment, since there is provided the head chip 50 in which the deterioration of the printing quality caused by the bonding defect is prevented as described above, it is possible to provide the inkjet head 5 and the printer 1 excellent in printing quality.

Second Embodiment

<Head Chip>

The head chip 50 according to a second embodiment will be described.

Figure 13:
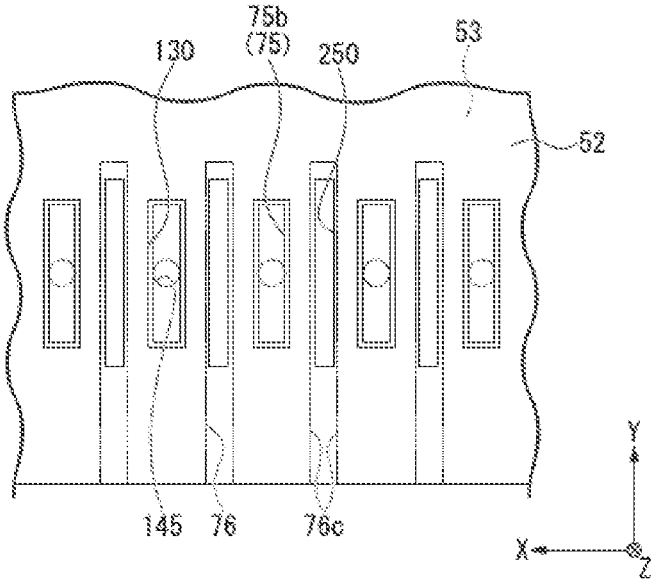
FIG. 13 is a bottom view of an actuator plate in a second embodiment.

FIG. 13 is a bottom view of an actuator plate in the second embodiment.

As shown in FIG. 13, the present embodiment is different from the first embodiment in the point that through holes 250 are each disposed over the entire length in the Y direction between the respective penetration parts 75*b* of the pair of ejection channels 75 adjacent to each other in the X direction. The through holes 250 each protrude to the outside in the Y direction beyond the both ends of each of the penetration parts 75*b* of the pair of ejection channels 75 across the through hole 250 in the plan view. In other words, the through hole 250 is disposed over an area from one outside to the other outside in the Y direction of each of the penetration parts 75*b* of the pair of ejection channels 75. The through holes 250 are each disposed at the inner side in the X direction of the inner surfaces 76*c* extending in the Y direction of the non-ejection channel 76 in the plan view. The whole of the through hole 250 overlaps the non-ejection channel 76 in the plan view. In the present embodiment, the through hole 250 is formed to have a rectangular planar shape smaller in the X direction than the non-ejection channel 76 and larger in the Y direction than the penetration part 75*b* of the ejection channel 75. It should be noted that the rest of the configuration is substantially the same as that of the first embodiment.

As described above, in the present embodiment, the through holes 250 are each disposed over the entire length in the Y direction between the penetration parts 75*b* of the pair of ejection channels 75 adjacent to each other in the plan view. According to this configuration, the through holes 250 are each disposed on all of the paths extending linearly from one communication hole 130 toward the other communication hole 130 in a portion where the intermediate plate 52 and the nozzle plate 51 are opposed to each other. Thus, it is possible to more surely detect the bonding defect which is apt to induce the communication between the ejection channels 75.

Third Embodiment

<Head Chip>

The head chip 50 according to a third embodiment will be described.

Figure 14:
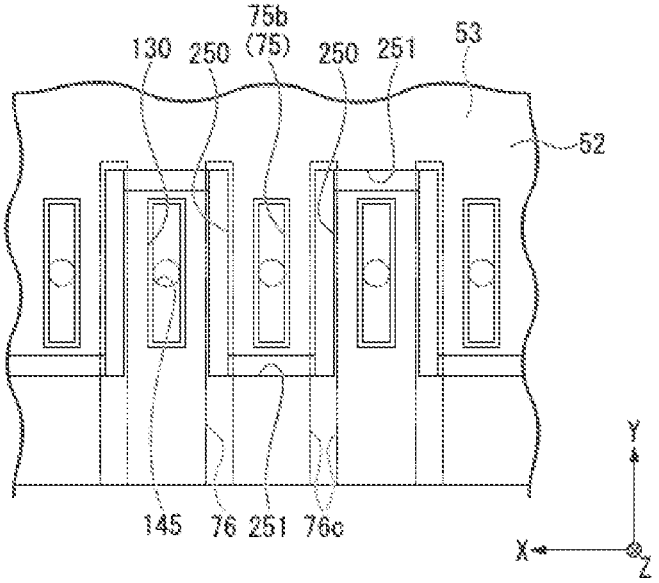
FIG. 14 is a bottom view of an actuator plate in a third embodiment.

FIG. 14 is a bottom view of an actuator plate in the third embodiment.

As shown in FIG. 14, the present embodiment is different from the second embodiment in the point that the intermediate plate 52 is provided with connection grooves 251 for connecting the pair of through holes 250 adjacent to each other in the X direction. It should be noted that the rest of the configuration is substantially the same as that of the second embodiment.

The connection grooves 251 are formed on the obverse surface of the intermediate plate 52. The connection grooves 251 are formed so as not to penetrate the intermediate plate 52. The connection grooves 251 each extend linearly along the X direction at the outer side in the Y direction of the penetration part 75*b* of the ejection channel 75. The connection grooves 251 each extend so as to connect end portions of the pair of through holes 250 (a first through hole and a second through hole) adjacent to each other. To the end portion of each of the through holes 250, there is connected just one connection groove 251. Thus, a recessed part constituted by the through holes 250 and the connection grooves 251 extends forming a zigzag shape so as to circumvent the ejection channels 75 one by one in the plan view. For example, the connection grooves 251 are formed using the laser similarly to the through holes 250. In this case, by setting the output of the laser when forming the connection grooves 251 lower than the output of the laser when forming the through holes 250, it is possible to form the connection grooves 251 which do not penetrate the intermediate plate 52.

As described above, in the present embodiment, on the obverse surface of the intermediate plate 52, there are formed the connection grooves 251 each connecting the pair of through holes 250 adjacent to each other in the X direction to each other. According to this configuration, by forming the connection grooves 251 using substantially the same measure as in the through holes 250 so as not to penetrate the intermediate plate 52, it is possible to form the pair of through holes 250 and the connection groove 251 in a lump. Thus, it is possible to reduce the processing time of the intermediate plate 52 compared to when the through holes 250 respectively communicated with the pair of non-ejection channels 76 adjacent to each other are formed independently of each other.

Fourth Embodiment

<Head Chip>

The head chip 50 according to a fourth embodiment will be described.

Figure 15:
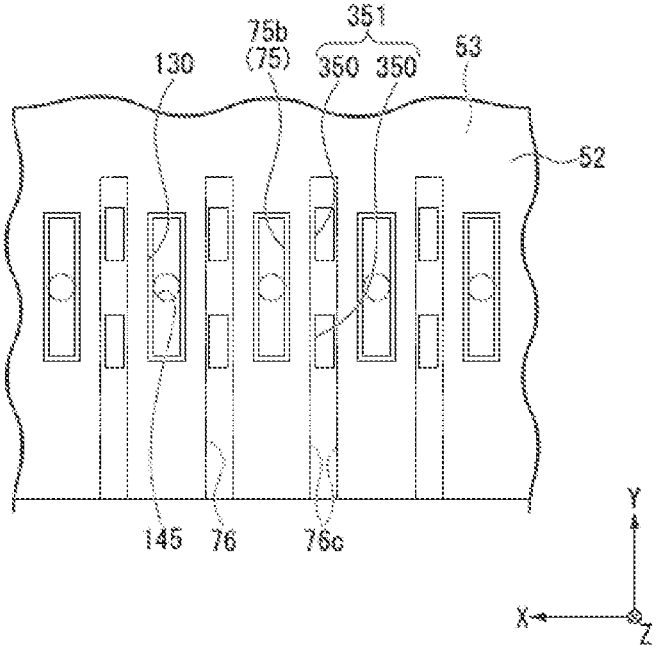
FIG. 15 is a bottom view of an actuator plate in a fourth embodiment.

FIG. 15 is a bottom view of an actuator plate in the fourth embodiment.

As shown in FIG. 15, the present embodiment is different from the first embodiment in the point that the intermediate plate 52 is provided with a plurality of through holes 350 communicated with the same non-ejection channel 76. It should be noted that the rest of the configuration is substantially the same as that of the first embodiment.

The intermediate plate 52 is provided with through hole groups 351. The through hole group 351 has a plurality of (two in the illustrated example) through holes 350 disposed between the pair of ejection channels 75 adjacent to each other viewed from the X direction. The through hole group 351 is formed in an area extending from one outside to the other outside in the Y direction of each of the penetration parts 75*b* of the pair of ejection channels 75. In other words, at least a pair of through holes 350 in the through hole group 351 are disposed at the outer side in the Y direction beyond the both ends of each of the penetration parts 75*b* of the pair of ejection channels 75 across the through hole group 351 in the plan view. It should be noted that it is possible for all of the through holes in the through hole group to be disposed at the inner side in the Y direction of the both ends of each of the penetration parts 75*b* of the pair of ejection channels 75 across the through hole group in the plan view. The through holes 350 are each disposed at the inner side in the X direction of the inner surfaces 76*c* extending in the Y direction of the non-ejection channel 76 in the plan view. In the present embodiment, the through holes 350 are each formed to have a rectangular planar shape smaller in the X direction than the non-ejection channel 76. It should be noted that in the illustrated example, the through holes 350 are formed so as to avoid the center in the Y direction in each of the pair of ejection channels 75 in the plan view, but the arrangement of the through holes 350 is not limited to this example. Specifically, one of the through holes 350 in the through hole group 351 can be disposed between the respective centers in the Y direction of the pair of ejection channels 75 in the plan view.

As described above, in the present embodiment, the plurality of through holes 350 communicated with the same non-ejection channel 76 is provided to the intermediate plate 52. According to this configuration, by forming the through holes 350 communicated with the same non-ejection channel 76 in a distributed manner, it is possible to keep the area of the bonding area between the intermediate plate 52 and the nozzle plate 51 while suppressing the decrease in the formation range of the through holes 350 compared to a configuration in which a single through hole is formed. Therefore, it is possible to suppress the deterioration of the bonding strength between the intermediate plate 52 and the nozzle plate 51 caused by forming the through holes 350.

It should be noted that the technical scope of the present disclosure is not limited to the embodiments described above, but a variety of modifications can be applied within the scope or the spirit of the present disclosure.

For example, in the embodiments described above, the description is presented citing the inkjet printer 1 as an example of the liquid jet recording device, but the liquid jet recording device is not limited to the printer. For example, a facsimile machine, an on-demand printing machine, and so on can also be adopted.

In the embodiments described above, the description is presented citing the configuration (a so-called shuttle machine) in which the inkjet heads move with respect to the recording target medium when performing printing as an example, but this configuration is not a limitation. The configuration related to the present disclosure can be adopted as the configuration (a so-called stationary head machine) in which the recording target medium is moved with respect to the inkjet head in the state in which the inkjet head is fixed.

In the embodiments described above, there is described the configuration in which the Z direction coincides with the vertical direction, but this configuration is not a limitation, and it is also possible to set the Z direction along the horizontal direction.

In the embodiments described above, the head chip of the side-shoot type is described, but this is not a limitation. For example, it is also possible to apply the present disclosure to a head chip of a so-called edge-shoot type for ejecting the ink from an end portion in the extending direction in the ejection channel.

In the embodiments described above, there is described when the recording target medium P is paper, but this configuration is not a limitation. The recording target medium P is not limited to paper, but can also be a metal material or a resin material, and can also be food or the like.

In the embodiments described above, there is described the configuration in which the liquid jet head is installed in the liquid jet recording device, but this configuration is not a limitation. Specifically, the liquid to be jetted from the liquid jet head is not limited to what is landed on the recording target medium, but can also be, for example, a medical solution to be blended during a dispensing process, a food additive such as seasoning or a spice to be added to food, or fragrance to be sprayed in the air.

In the embodiments described above, there are disposed two channel columns, but the number of the channel columns is not particularly limited.

In the embodiments described above, the through holes 150, 250, or 350 of the intermediate plate 52 are each formed to have a rectangular planar shape, but this is not a limitation. For example, the through holes can be formed to have a circular shape, an oval shape, or the like.

Besides the above, it is arbitrarily possible to replace the constituent in the embodiments described above with a known constituent within the scope or the spirit of the present disclosure, and further, it is possible to arbitrarily combine the embodiments described above with each other.

What is claimed is:

1. A head chip comprising:

an actuator plate in which a jet channel extending in a first direction and a non-jet channel extending in the first direction are alternately arranged in a second direction crossing the first direction;

an intermediate plate which is overlapped with the actuator plate in a third direction perpendicular to the first direction and the second direction, and is provided with a communication hole communicated with the jet channel, and a through hole communicated with the non-jet channel; and a jet orifice plate which is overlapped with the intermediate plate at an opposite side to the actuator plate in the third direction in a state of closing the through hole, and is provided with a jet orifice which is communicated with the communication hole, from which liquid contained in the jet channel is jetted, and which is formed at a position corresponding to the jet channel, wherein the non-jet channel is communicated with an outside of the head chip, and the through hole is disposed at an inner side in the second direction of inner surfaces extending in the first direction of the non-jet channel, viewed from the third direction.

2. The head chip according to claim 1, wherein the jet channels include a first jet channel and a second jet channel adjacent to each other in the second direction, and the through hole is disposed between the first jet channel and the second jet channel, viewed from the third direction.

3. The head chip according to claim 2, wherein the through hole is disposed at an inner side in the first direction of both ends of each of the first jet channel and the second jet channel, viewed from the third direction.

4. The head chip according to claim 3, wherein the through hole is disposed between a center in the first direction of the first jet channel and a center in the first direction of the second jet channel, viewed from the third direction.

5. The head chip according to claim 2, wherein the through hole is disposed over an entire length in the first direction between the first jet channel and the second jet channel, viewed from the third direction.

6. The head chip according to claim 2, wherein the non-jet channels include a first non-jet channel and a second non-jet channel adjacent to each other in the second direction, the through holes include a first through hole communicated with the first non-jet channel, and a second through hole communicated with the second non-jet channel, and a bonding surface of the intermediate plate to the jet orifice plate is provided with a connection groove configured to connect the first through hole and the second through hole to each other.

7. The head chip according to claim 1, wherein the intermediate plate is provided with a plurality of through holes communicated with the same non-jet channel.

8. A liquid jet head comprising the head chip according to claim 1.

9. A liquid jet recording device comprising the liquid jet head according to claim 8.

10. A method of manufacturing a head chip, comprising:

a through hole formation step of providing a through hole to an intermediate plate overlapped with, and then bonded to, an actuator plate in a third direction perpendicular to a first direction and a second direction crossing the first direction, the actuator plate provided with a jet channel extending in the first direction and a non-jet channel extending in the first direction, the jet channel and the non-jet channel alternatively arranged in the second direction, the through hole disposed at an inner side in the second direction of inner surfaces extending in the first direction of the non-jet channel, viewed from the third direction; and a bonding step of overlapping a jet orifice plate provided with a jet orifice, from which liquid contained in the jet channel is jetted, with the intermediate plate provided with a communication hole communicated with the jet channel and the jet orifice at an opposite side to the actuator plate, and then bonding the jet orifice plate to the intermediate plate so as to close the through hole.

* * * * *